US010161570B2

(12) United States Patent
Yuan et al.

(10) Patent No.: US 10,161,570 B2
(45) Date of Patent: Dec. 25, 2018

(54) LIGHTING DEVICE AND LUMINAIRE

(71) Applicant: PHILIPS LIGHTING HOLDING B.V., Eindhoven (NL)

(72) Inventors: Mou Kun Yuan, Eindhoven (NL); Xuefei Yang, Eindhoven (NL); Zhong Wang, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/110,428

(22) PCT Filed: Jan. 12, 2015

(86) PCT No.: PCT/EP2015/050416
§ 371 (c)(1),
(2) Date: Jul. 8, 2016

(87) PCT Pub. No.: WO2015/110306
PCT Pub. Date: Jul. 30, 2015

(65) Prior Publication Data

US 2016/0334066 A1 Nov. 17, 2016

(30) Foreign Application Priority Data

Jan. 22, 2014 (WO) ..... PCT/CN2014/071070
Apr. 3, 2014 (EP) ..... 14163386

(51) Int. Cl.
*F21K 9/278* (2016.01)
*F21V 7/00* (2006.01)
(Continued)

(52) U.S. Cl.
CPC ..... *F21K 9/278* (2016.08); *F21K 9/272* (2016.08); *F21K 9/275* (2016.08); *F21K 9/68* (2016.08);
(Continued)

(58) Field of Classification Search
CPC .... F21K 9/278; F21K 9/68; F21S 4/28; F21V 3/02; F21V 3/0427; F21Y 2103/10
See application file for complete search history.

(56) References Cited

U.S. PATENT DOCUMENTS 6,644,834 B2 11/2003 Christen
9,285,084 B2 * 3/2016 Amrine, Jr. ..... F21K 9/17
(Continued)

FOREIGN PATENT DOCUMENTS

CN 102230581 A 11/2011
CN 203099392 U 7/2013
(Continued)

*Primary Examiner* — Jong-Suk (James) Lee
*Assistant Examiner* — Christopher E Dunay
(74) *Attorney, Agent, or Firm* — Akarsh P. Belagodu

(57) ABSTRACT

Disclosed is a lighting device (100) comprising a tubular body (120), said tubular body comprising a carrier (130) mounted inside the tubular body such that the tubular body comprises a first inner volume (102) delimited by a first arcuate section (121) of the tubular body and the carrier; and a second inner volume (104) delimited by a second arcuate section (124) of the tubular body and the carrier, wherein the carrier supports a plurality of solid state lighting elements (32) arranged to emit a luminous output into the first inner volume; and the first arcuate section (121) comprises a transparent region (123) and a translucent region (122) obscuring the solid state lighting elements, said transparent region extending from the translucent region to the carrier; wherein the carrier (130) comprises a central region extending along the length of the tubular body (120), and defining a recess in which the solid state lighting elements (32) are located, which recess prevents the solid state lighting elements (32) from being directly observable through the transparent region (123) of the first arcuate section (121). A luminaire (200) comprising at least one such a lighting device (100) is also disclosed.

18 Claims, 8 Drawing Sheets

(51) Int. Cl.

| | |
|---|---|
| ***F21S 4/28*** | (2016.01) |
| ***F21K 9/272*** | (2016.01) |
| ***F21V 3/02*** | (2006.01) |
| ***F21V 7/22*** | (2018.01) |
| ***F21V 15/015*** | (2006.01) |
| ***F21V 23/00*** | (2015.01) |
| ***F21K 9/275*** | (2016.01) |
| ***F21K 9/68*** | (2016.01) |
| ***F21V 3/06*** | (2018.01) |
| *F21Y 103/10* | (2016.01) |
| *F21Y 115/10* | (2016.01) |

(52) U.S. Cl.

CPC ..... *F21S 4/28* (2016.01); *F21V 3/02* (2013.01); *F21V 3/0615* (2018.02); *F21V 3/0625* (2018.02); *F21V 7/005* (2013.01); *F21V 7/22* (2013.01); *F21V 15/015* (2013.01); *F21V 23/003* (2013.01); *F21V 23/005* (2013.01); *F21Y 2103/10* (2016.08); *F21Y 2115/10* (2016.08)

(56) References Cited

U.S. PATENT DOCUMENTS

2009/0219713 A1* 9/2009 Siemiet ..... F21V 3/02 362/218
2010/0008085 A1* 1/2010 Ivey ..... F21K 9/27 362/218
2010/0220469 A1* 9/2010 Ivey ..... F21K 9/27 362/218
2010/0321921 A1* 12/2010 Ivey ..... F21K 9/64 362/84
2011/0090680 A1* 4/2011 Steinkraus ..... F21V 14/04 362/217.05
2011/0292652 A1* 12/2011 Huang ..... F21V 5/002 362/235
2011/0298355 A1 12/2011 Van De Ven
2011/0305024 A1* 12/2011 Chang ..... F21V 5/02 362/294
2012/0051039 A1* 3/2012 Chang ..... F21V 13/04 362/218
2012/0106144 A1* 5/2012 Chang ..... F21K 9/17 362/218
2012/0155095 A1* 6/2012 Ryan, Jr. ..... B21D 5/08 362/382
2012/0161626 A1* 6/2012 van de Ven ..... F21V 3/02 315/35
2013/0033888 A1* 2/2013 Van Der Wel ..... F21V 1/06 362/555
2013/0093359 A1* 4/2013 Hsu ..... F21V 19/003 315/312
2014/0029246 A1* 1/2014 Umeda ..... F21V 7/22 362/217.05
2014/0340896 A1* 11/2014 Verbeek ..... F21V 7/0008 362/235
2015/0146407 A1* 5/2015 Boonekamp ..... F21V 3/02 362/84
2016/0109068 A1* 4/2016 Boonekamp ..... F21K 9/17 362/218
2017/0089530 A1* 3/2017 Jiang ..... F21K 9/60
2017/0102129 A1* 4/2017 Yuan ..... F21V 13/12

FOREIGN PATENT DOCUMENTS

| | | | |
|---|---|---|---|
| DE | 102011086628 | A1 | 5/2013 |
| JP | 2010272496 | A | 12/2010 |
| WO | WO2009133615 | A1 | 11/2009 |
| WO | WO2013002363 | A1 | 1/2013 |

* cited by examiner

LIGHTING DEVICE AND LUMINAIRE

CROSS-REFERENCE TO PRIOR APPLICATIONS

This application is the U.S. National Phase application under 35 U.S.C. § 371 of International Application No. PCT/EP2015/050416, filed on Jan. 12, 2015, which claims the benefit of European Patent Application No. 14163386.7, filed on Apr. 3, 2014 and Chinese Patent Application No. PCT/CN2014/071070, filed on Jan. 22, 2014. These applications are hereby incorporated by reference herein.

FIELD OF THE INVENTION

The present invention relates to a lighting device comprising a tubular body into which a plurality of solid state lighting elements is fitted.

The present invention further relates to a luminaire comprising such a lighting device.

BACKGROUND OF THE INVENTION

With a continuously growing population, it is becoming increasingly difficult to meet the world's energy needs as well as to control carbon emissions to kerb greenhouse gas emissions that are considered responsible for global warming phenomena. These concerns have triggered a drive towards a more efficient use of electricity in an attempt to reduce energy consumption.

One such area of concern is lighting applications, either in domestic or commercial settings. There is a clear trend towards the replacement of traditional energy-inefficient light bulbs such as incandescent or fluorescent light bulbs with more energy efficient replacements. Indeed, in many jurisdictions the production and retailing of incandescent light bulbs has been outlawed, thus forcing consumers to buy energy-efficient alternatives, e.g. when replacing incandescent light bulbs.

A particularly promising alternative is provided by solid state lighting (SSL) devices, which can produce a unit luminous output at a fraction of the energy cost of incandescent or fluorescent light bulbs. An example of such a SSL element is a light emitting diode.

A problem associated with SSL element-based lighting devices it is far from trivial to produce a lighting device having an appearance that is comparable with traditional lighting devices such as incandescent and fluorescent light bulbs. Because customers are used to the appearance of such traditional lighting devices, acceptance of SSL element-based lighting devices typically is largely dependent on the similarity of the appearance of the device in operation when compared to such traditional lighting devices. An appearance that is dissimilar to traditional lighting devices can hamper the market penetration of the SSL element-based lighting devices because customers may dislike the different appearance of such devices. This is for instance problematic in tubular lighting devices based on SSL elements such as tubular light bulbs.

An example of such a prior art tubular lighting device is shown in FIG. 1. The lighting device 10 comprises a tubular body 20 having an inner volume comprising a printed circuit board 30 onto which a plurality of LEDs 32 are mounted at regular intervals. The LEDs 32 act as a point light sources, which can give the lighting device 10 a spotted a luminous appearance, which is notably different to the appearance of a fluorescent tube, which typically produces a substantially homogeneous or uniform luminous output.

In order for the lighting device 10 to produce a more uniform luminous output, the tubular body 20 may act as a diffuser, for instance by forming the tubular body 20 from a homogeneously diffused plastic or by providing a glass or plastic tubular body 20 with a diffuser coating. Such a diffuser may furthermore be desirable to prevent the LEDs from being directly observable, e.g. to prevent glare. However, high levels of diffusion may be required in order to generate the desired uniform luminous distribution. This is for instance the case if the lighting device 10 comprises a relatively small number of LEDs 32, in which case the LEDs 32 are spaced apart by relatively large distances. If such high levels of diffusion are required, this means that the light generated by the LEDs 32 typically is reflected several times inside the tubular body 20 before exiting this body. This can significantly reduce the optical efficiency of the lighting device 10, which is undesirable.

Moreover, approximately only half of the circumference of the tubular body 20 acts as a light exit window due to the fact that the printed circuit board 30 prevents light generated by the LEDs 32 to be reflected towards the arcuate section of the tubular body 20 underneath the printed circuit board 30, i.e. the part of the tubular body 20 that is not directly exposed to the luminous output of the LEDs 32. FIG. 2 depicts a cross-sectional light distribution plot of the lighting device 10 of FIG. 1 and FIG. 3 depicts a light distribution plot of the lighting device 10 of FIG. 1 along the tubular body 20, from which it is clear that the luminous distribution produced by the lighting device 10 is limited to a range of viewing angles of approximately 180° due to the presence of the planar printed circuit board 30 extending across the width of the tubular body 20.

JP 2010-272496 (A) discloses a LED fluorescent illumination apparatus having a tubular body composed of a first arcuate section made of a translucent synthetic resin and a second arcuate section made of a metal. An inner wall having a horizontal plane and a pair of inclined planes is located inside the tubular body with the horizontal plane positioned closer to the second arcuate section than the tubular body centre. LED light-emitting devices and phosphor are mounted on the upper surface of the horizontal plane of the inner wall. Generated fluorescent light is radiated from almost all the surface of the inner wall to the first tubular body such that a diffused light output is produced over an increased angular distribution compared to the lighting device 10 in FIG. 1. However, this apparatus still requires heavy diffusion to obtain the desired luminous distribution, which reduces the efficiency of the apparatus.

SUMMARY OF THE INVENTION

The present invention seeks to provide a lighting device according to the opening paragraph that can produce a luminous distribution over a wide range of viewing angles at good efficiency.

The present invention further seeks to provide a luminaire comprising such a lighting device.

According to an aspect, there is provided a lighting device comprising a tubular body, said tubular body comprising a carrier mounted inside the tubular body such that the tubular body comprises a first inner volume delimited by a first arcuate section of the tubular body and the carrier; and a second inner volume delimited by a second arcuate section of the tubular body and the carrier, wherein the carrier supports a plurality of solid state lighting elements arranged to emit a luminous output into the first inner volume; and the first arcuate section comprises a transparent region and a translucent region obscuring the solid state lighting elements, said transparent region extending from the translucent region to the carrier. The carrier comprises a central region extending along the length of the tubular body, and defining a recess in which the solid state lighting elements are located, which recess prevents the solid state lighting elements from being directly observable through the transparent region of the first arcuate section.

The present invention is based on the realization that the inclusion of a transparent region under shallow angles, i.e., in close vicinity to the meeting point between the carrier and the tubular body allows for an increased amount of light to escape the lighting device with minimal reflection, thereby increasing the luminous efficiency of the lighting device, whilst avoiding the risk of a substantial increase in glare produced by the lighting device. This for instance may be achieved by shaping the carrier such that the solid state lighting elements cannot be directly observed through the transparent region or by the positioning of the tubular lighting device in a luminaire such as a ceiling luminaire.

In an embodiment, the first arcuate section comprises a pair of transparent regions each extending from the translucent region to the carrier, said transparent regions facing each other, wherein the translucent region extends between said transparent regions. By providing transparent regions on either side of the carrier, more light generated by the SSL elements can escape the tubular body with minimal reflections, thereby further increasing the luminous efficiency of the lighting device.

The translucent region may be realized as an integral part of the tubular body, for instance by etching part of the tubular body or by co-extrusion. Alternatively, the translucent region may comprise a translucent film on a surface portion of the tubular body.

The carrier may comprise a heat sink to ensure that the heat generated by the SSL elements is effectively dissipated, thereby ensuring that the SSL elements operate within a desirable temperature range.

The solid state lighting elements may be mounted on a printed circuit board supported by said carrier. Alternatively, the SSL elements may be mounted directly on said carrier.

In an embodiment, the carrier comprises a reflective surface facing the first inner volume. This increases the amount of light reflected by the carrier, such that the overall luminous efficiency of the lighting device is improved. The reflective surface may be either specular reflective or scattering reflective.

The reflective surface may comprise a central portion comprising a plurality of apertures each exposing one of said solid state lighting elements; a pair of sloped first sections extending from said central portion and defining a trench in which the solid state lighting elements are located; and a pair of second sections each extending from one of the first sections to the tubular body. By providing the SSL elements in a reflective trench, the range of viewing angles under which the SSL elements can be directly observed is further reduced such that the transparent section(s) may be increased, thereby further increasing the amount of light that can directly escape the tubular body, which further increases the luminous efficiency of the lighting device.

Advantageously, the second sections are angled from the first section to the tubular body such that the first arcuate section extends over angular range of more than 180°. This increases the range of angles under which the lighting device outputs light (as the first arcuate section defines the light exit portion of the lighting device), which may give the lighting device a further improved appearance and may further increase the luminous efficiency of the lighting device.

The reflective surface may be realized as a reflective layer on the heat sink, which has the advantage that the heat sink itself does not have to be reflective, thereby increasing the design flexibility of the heat sink because non-reflective materials may also be considered. Alternatively, the heat sink itself may be reflective in which case the reflective layer may be omitted.

In an embodiment, the carrier further comprises a pair of arcuate carrier sections, each arcuate carrier section extending along a portion of the second arcuate section of the tubular body. This increases the contact surface between the carrier and the tubular body, which may aid in securing the carrier inside the tubular body and may increase heat transfer between the carrier and the tubular body, which is particularly advantageous if the carrier acts as a heat sink, because the increased heat transfer means that the heat sink will have an improved capacity, which facilitates the inclusion of a larger number of SSL elements or more powerful SSL elements in the lighting device.

The tubular body may be a glass body or a plastic body. In case of the tubular body being a plastic body, the plastic may be selected from polycarbonate (PC), poly ethylene terephthalate (PET) and poly (methyl methacrylate) (PMMA) or mixtures thereof. Such plastics or polymers can be produced to have excellent optical properties as well as good thermal conductivity, and are therefore particularly suitable materials for such a tubular body.

In an embodiment, the translucent region forms between 25-40% of the tubular body, such as one third of said tubular body. In other words, the translucent region may cover an arcuate section of the tubular body in the range of about 90-144°, as the first arcuate section including the translucent region typically extends over at least 180° of the tubular body, this means at least about 36° of the first arcuate section is transparent to ensure that the lighting device has the desirable luminous efficiency.

The lighting device may further comprise driver circuitry for driving the plurality of solid state lighting elements, said driver circuitry being located in the second inner volume. This has the advantage that the driver circuitry cannot be observed by an external observer, thereby improving the appearance of the lighting device.

According to another aspect, there is provided a luminaire comprising the lighting device according to one or more of the aforementioned embodiments. Such a luminaire may for instance be a holder of the lighting device, e.g. a ceiling luminaire, or an apparatus into which the lighting device is integrated.

BRIEF DESCRIPTION OF THE DRAWINGS

Embodiments of the invention are described in more detail and by way of non-limiting examples with reference to the accompanying drawings, wherein FIG. 1 schematically depicts a perspective view of a prior art tubular lighting device.

DETAILED DESCRIPTION OF THE EMBODIMENTS

Figure 1:
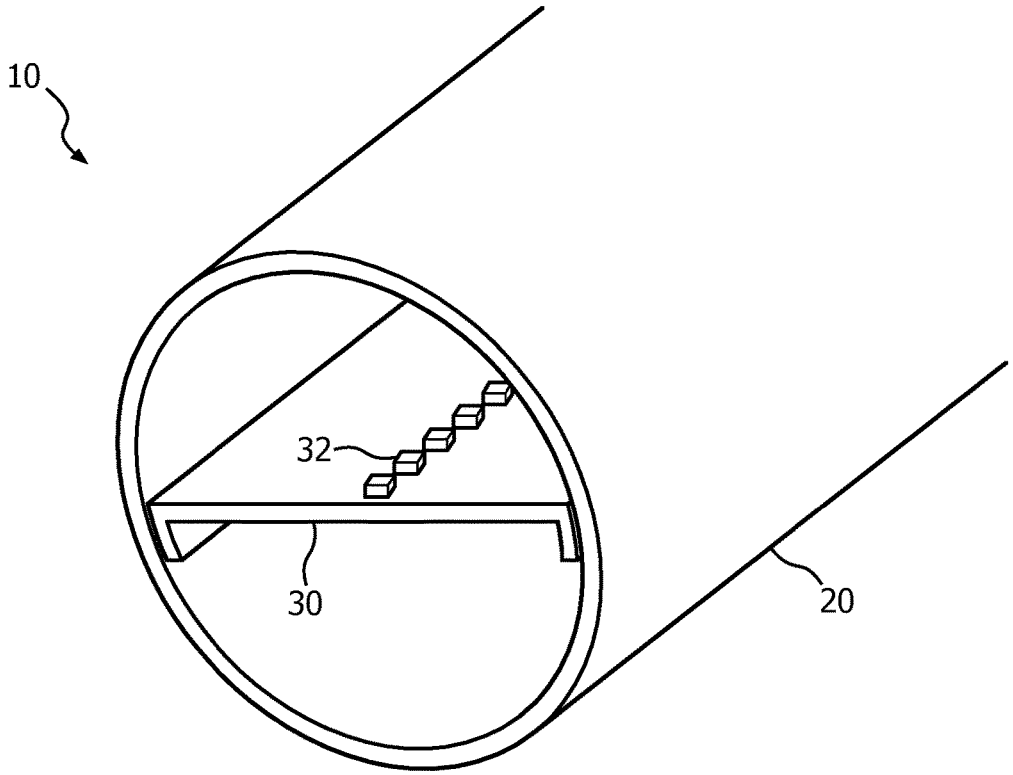
FIG. 1 (Prior art)
Figure 2:
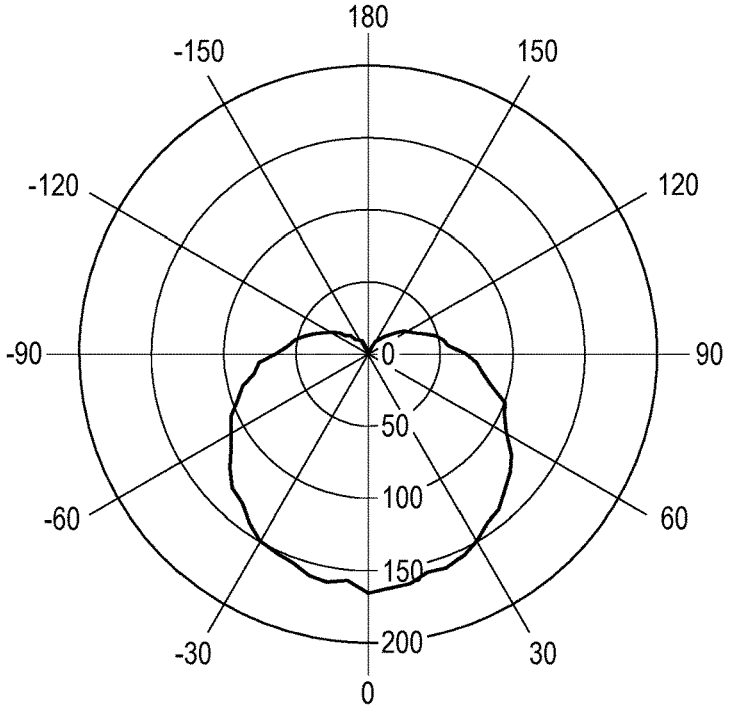
FIG. 2 (Prior art)
FIG. 2 depicts a plot of a cross-sectional luminous distribution produced by the prior art tubular lighting device of FIG. 1.
Figure 3:
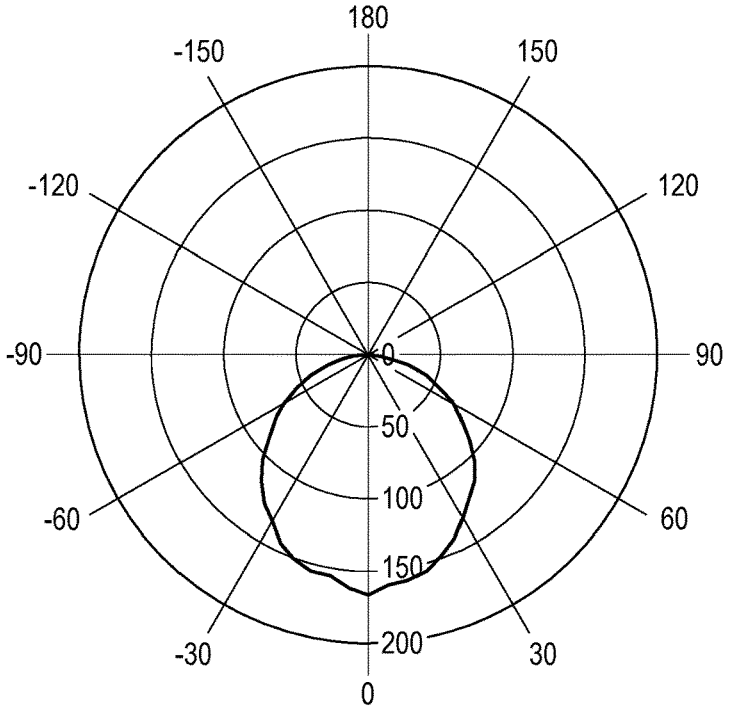
FIG. 3 (Prior art)
FIG. 3 depicts a plot of a luminous distribution produced by the prior art tubular lighting device of FIG. 1 in the direction of the tubular body.

It should be understood that the Figures are merely schematic and are not drawn to scale. It should also be understood that the same reference numerals are used throughout the Figures to indicate the same or similar parts.

Figure 4:
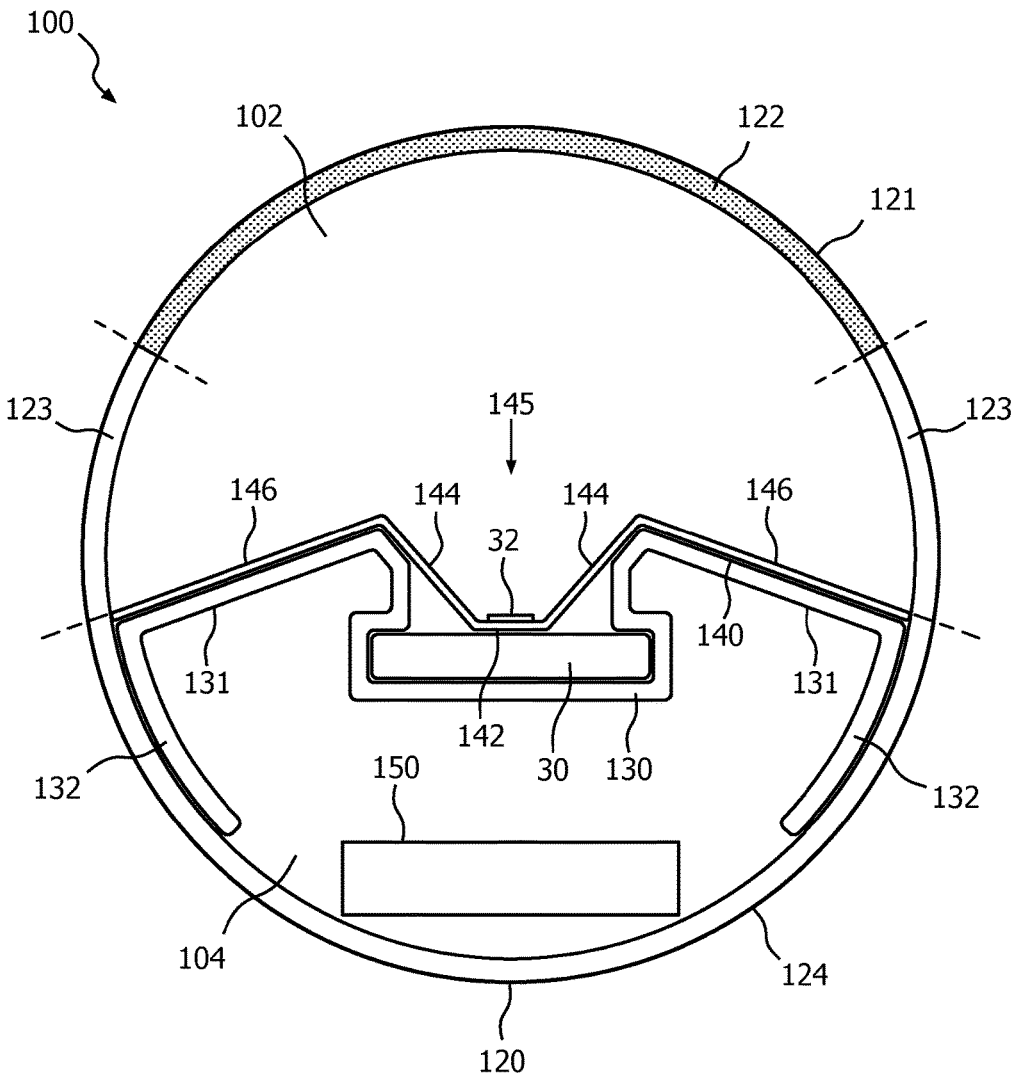
FIG. 4 schematically depicts a cross-section of a lighting device according to an embodiment of the present invention.
Figure 5:
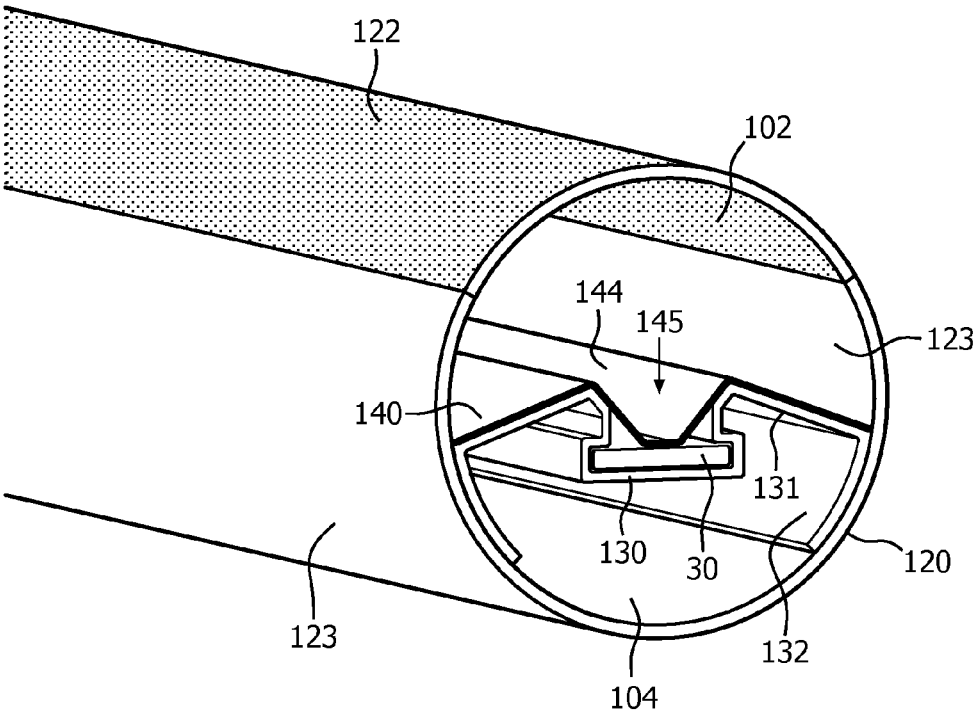
FIG. 5 schematically depicts a perspective view of the lighting device of FIG. 4.

FIG. 4 schematically depicts a cross-section of a lighting device 100 according to an embodiment of the present invention, whereas FIG. 5 schematically depicts the lighting device 100 in perspective view. The lighting device 100 comprises a tubular body 120 housing a carrier 130 that extends across the width of the tubular body 120, thereby dividing the inner volume of the tubular body 120 into a first inner volume 102 delimited by the carrier 130 and a first arcuate section 121 of the tubular body 120 and a second inner volume 104 delimited by the carrier 130 and a second arcuate section 124 of the tubular body 120.

The carrier 130 typically carries a plurality of solid state lighting (SSL) elements 32, e.g. light emitting diodes. The plurality of SSL elements 32 may be spaced along the carrier 130 in any suitable pattern. For instance, the SSL elements 32 may be equidistantly spaced along the carrier 30 in a length direction of the tubular body 120. Any suitable number of SSL elements 32 may be carried by the carrier 130. In an embodiment, the SSL elements 32 may be mounted on a supporting structure such as a printed circuit board 30, which supporting structure may be carried by the carrier 130, as is shown in FIG. 4. Each SSL element 32 may be mounted on a separate supporting structure or at least some SSL elements 32 may share a supporting structure. For instance, the SSL elements 32 may be mounted on a single supporting structure. Alternatively, the SSL elements 32 may be directly mounted onto the carrier 130.

In an embodiment, the carrier 130 acts as a heat sink for the plurality of SSL elements 32. The carrier 130 may be made of any suitable material, which may be a thermally conductive material in case the carrier 130 acts as a heat sink. Examples of such a thermally conductive material include metals and metal alloys. A particularly suitable metal is aluminium, because aluminium is pliable such that the carrier 130 can be readily shaped into its desired shape. However, it will be understood that other suitable thermally conductive materials, e.g. other suitable metals are readily available to the skilled person and any of these suitable alternatives may be contemplated for use in the lighting device 100 according to embodiments of the present invention.

The SSL elements 32 are placed with their luminous surfaces facing the first inner volume 102. In other words, the SSL elements 32 are arranged to emit light into the first inner volume 102. In order to prevent the SSL elements 32 from being directly observable in normal use of the lighting device 100, the first arcuate section 121 of the tubular body 120 comprises a translucent region 122 that obscures the SSL elements 32 in such normal use. The translucent region 122 may act as a diffuser of the light generated by the SSL elements 32 such that the SSL elements 32 cannot be detected as separate luminous point sources but instead the lighting device 100 will give a uniform appearance in normal use.

In at least some embodiments, the translucent region 122 covers at least 25% of the circumference of the tubular body 120, such as one third of the circumference. In an embodiment, the translucent region 122 covers 25-40% of the circumference of the tubular body 120, i.e. extends over an angular range of about 90° to about 145° of the full 360° circumference of the tubular body 120 although alternative ranges may be equally feasible depending on the application domain in which the lighting device 100 is to be used. In at least some embodiments, both the SSL elements 32 and the translucent region 122 are centered relative to a vertical plane of symmetry of the tubular body 120.

The first arcuate section 121 further comprises at least one transparent region 123 (the boundaries of which are indicated by the dashed lines), which transparent region extends from the translucent region 122 to the carrier 130. In FIG. 4, the lighting device 100 comprises a pair of transparent regions 123 that face each other, i.e. are located at opposite ends of the carrier 130. In FIG. 4, the opposing transparent regions 123 are dimensioned equally. However, it should be understood that this is by way of non-limiting example only and that it is equally feasible that one of the transparent regions 123 is larger than the other. Similarly, it is equally feasible that one of the transparent regions 123 is replaced by a translucent region, e.g. that the translucent region 122 extends from a transparent region 123 at one end of the carrier 130 to the other end of the carrier 130. It is furthermore feasible that the one or more transparent regions 123 are patterned regions, e.g. regions comprising a pattern of transparent and translucent portions. Other variations will be apparent to the skilled person.

A particular advantage of the combination of the translucent region 122 with one or more transparent regions 123 is that the SSL elements 32 may be spaced apart at relatively large distances (i.e. a relatively small number of SSL elements 32 may be integrated in the lighting device 100) because a heavily diffusing translucent region 122 may be used to ensure that the light generated by the SSL elements 32 is diffused to such an extent that the SSL elements 32 can no longer be observed as separate luminous point sources (spots). Due to the presence of the at least one transparent region 123, there is a modest performance penalty only in terms of luminous efficiency for the use of such a heavily diffusing translucent region 122 due to the fact that a substantial amount of light exits the lighting device 100 through the at least one transparent region 123 after a minimal number of reflections inside the tubular body 120, thus reducing the likelihood that such reflected light is inadvertently absorbed inside the lighting device 100.

In normal operation, the lighting device 100 may be fitted in a luminaire such as a ceiling armature, in which the translucent region 122 will be facing any external observer of the lighting device 100. Consequently, such an observer is not subjected to glare from the lighting device 100 because the observer is not directly exposed to the light generated by the SSL elements 32. However, due to the presence of the at least one transparent region 123 in the lighting device 100, at least some light can exit the lighting device 100 through the at least one transparent region 123 without or with minimal reflection, thereby increasing the luminous output of the lighting device 100, i.e. improving the luminous efficiency of the lighting device 100. Because the at least one transparent region 123 cannot be directly observed by an external observer during normal use of the lighting device 100, the presence of the at least one transparent region 123 does not significantly increase the risk of such an observer being confronted with glare issues.

In an embodiment, the carrier 130 comprises a central region in which the SSL elements 32 are located, which central region extends along the length of the tubular body 120. The central region may define a recess or trench in which the SSL elements 32 are located, which recess prevents the SSL elements 32 from being directly observable through the one or more transparent regions 123 of the first arcuate section 121. In addition, the carrier 130 may comprise portions 131 extending from the central region of the carrier 130 to the inner wall of the tubular body 120. The portions 131 may also be referred to as wings extending from the central region.

The portions 131 may extend from the central region under any angle relative to the horizontal plane of symmetry of the tubular body 120. However, in a preferred embodiment, the portions 131 are angled such that they at least partially extend underneath as well as away from this horizontal plane of symmetry in the direction of the inner wall of the tubular body 120, such that the first arcuate section 121 extends over an angular range of more than 180°, i.e., forms more than half the arcuate surface of the tubular body 120. This has the advantage that the size of the one or more transparent regions 123 may be increased such that the amount of light that can escape the tubular body 120 through these one or more transparent regions 123 can be increased, thereby improving the luminous efficiency of the lighting device 100 as well as increasing the angular luminous distribution produced by the lighting device 100, as will be demonstrated in more detail below.

In an embodiment, the carrier 130 further comprises a pair of arcuate carrier sections 132, each arcuate carrier section 132 extending from a portion 131 along a portion of the second arcuate section 124 of the tubular body 120. The arcuate carrier sections 132 may be included in the design of the carrier 132 increase the contact area between the carrier 130 and the tubular body 120. This for instance may be desirable to secure the carrier 130 within the tubular body 120 and/or to increase heat transfer between the carrier 130 and the tubular body 120, which for instance is relevant in particular when the carrier 130 also acts as a heat sink for the SSL elements 32. The increased heat transfer facilitates the use of a larger number and/or more powerful SSL elements 32, as the increased heat generated in this scenario can be effectively dissipated by the heat sink and transferred to the surroundings of the lighting device 100 via the tubular body 120.

The surface portions of the carrier 130 that face the first inner volume 102 preferably are reflective to ensure that the amount of light generated by the SSL elements 32 that exits the lighting device 100 through the translucent region 122 and the one or more transparent regions 123 is maximized. To this end, the carrier 130 may be made of a reflective material such as a polished metal or metal alloy, e.g. polished aluminium. Alternatively, as shown in FIGS. 4 and 5, the lighting device 100 may further comprise a reflective layer 140 mounted over the carrier 130 such that the reflective layer 140 is located in between the carrier 130 and the first inner volume 102. Any suitable reflective material, e.g. a reflective foil or the like, may be used for the reflective layer 140.

The reflective layer 140 preferably comprises a central portion 142 comprising a plurality of apertures 143 each exposing one of said solid state lighting elements 32. This is shown in more detail with the aid of FIG. 6, which schematically depicts a perspective view of a portion of the lighting device 100 in which a portion of the tubular body 120 has been removed for the sake of clarity. The reflective layer 140 further comprises a pair of sloped first sections 144 extending from the central portion 142 of the reflective layer 140. The sloped first sections 144 define a trench 145 in which the solid state lighting elements are located.

As previously explained, the purpose of such a trench 145 is to prevent the SSL elements 32 from being directly observable from outside the lighting device 100, which for instance helps to prevent glare. The reflective layer 140 may further comprise a pair of second sections 146, with each second section 146 extending from one of the first sections 144 to the tubular body 120. The second sections 146 may be in intimate contact with the winged portions 131 of the carrier 130. Consequently, each second section 146 may be angled from a first section 144 towards the tubular body 120 such that the first arcuate section 121 extends over angular range of more than 180° as explained in more detail above.

As previously explained, the reflective layer 140 may be omitted in case the carrier 130 comprises reflective surfaces facing the first inner volume 102. On the other hand, the presence of a reflective layer 140 allows for a separate optimization of the shape of the carrier 130 and the shape of the reflective layer 140. This is particularly relevant in the respective central regions of the carrier 130 and the reflective layer 140, where the carrier 130 for instance may require a shape that matches the shape of the support structure, e.g. a printed circuit board(s) 30 of the SSL elements 32, whereas the central region of the reflective layer 140 defined by the central portion 142 and the first sections 144 may be shaped such that the trench 145 has the desired optical properties to achieve the reflection of the light generated by the SSL elements 32 under the desired angles of reflection, e.g. by choosing an appropriate slope angle for the first sections 144. The slope angle may be defined as the angle between a horizontal plane of symmetry of the tubular body 120 and the plane of a first section 144.

A separate reflective layer 140 has the further advantage that the SSL elements 32 can be effectively surrounded by reflective surfaces due to the presence of the apertures 143 in the central portion 142 in the reflective film 140 having dimensions that match the dimensions of the SSL elements 32. Consequently, due to the fact that absorption of light emitted by the SSL elements 32 within the lighting device 100 is largely avoided, the luminous efficiency of the lighting device 100 is maximized.

The second inner volume 104 may be used to house the one or more driver circuits 150 for driving the plurality of SSL elements 32. The second inner volume 104 typically cannot be seen during normal use of the lighting device 100, such that it is not necessary to obscure the second inner volume 104, i.e. the second arcuate section 124 that delimits the second inner volume 104 may be transparent, which has the advantage that the tubular body 120 may have a single transparent section formed by the second arcuate section 124 and the transparent portion(s) 123 of the first arcuate section 121. However, it is equally feasible that the second arcuate section 124 is at least partially translucent.

Figure 6:
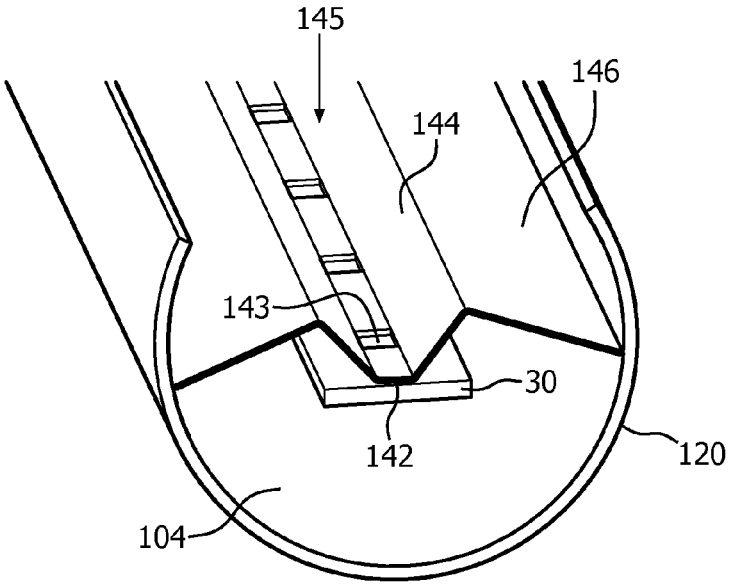
FIG. 6 schematically depicts an aspect of the lighting device of FIG. 4 in more detail.
Figure 7:
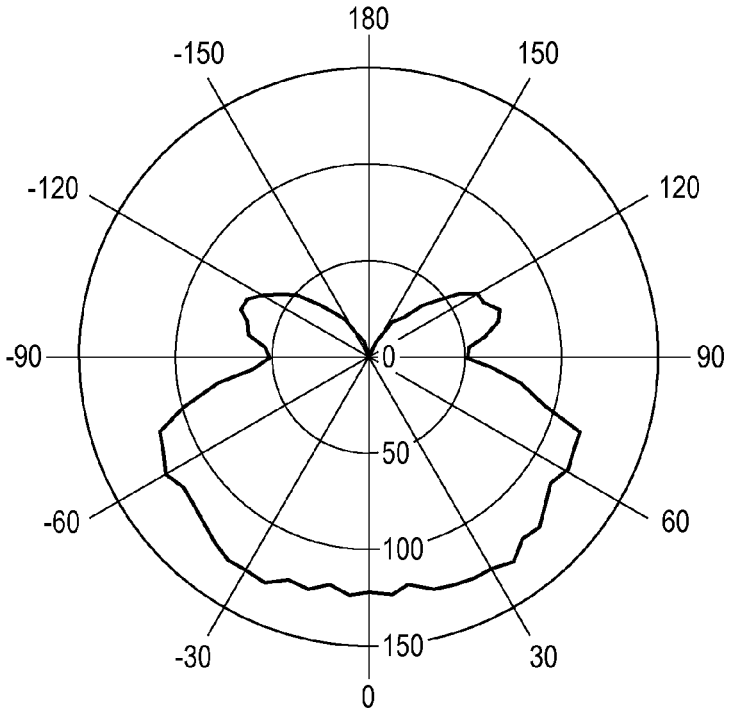
FIG. 7 depicts a plot of a cross-sectional luminous distribution produced by the lighting device of FIG. 4.
Figure 8:
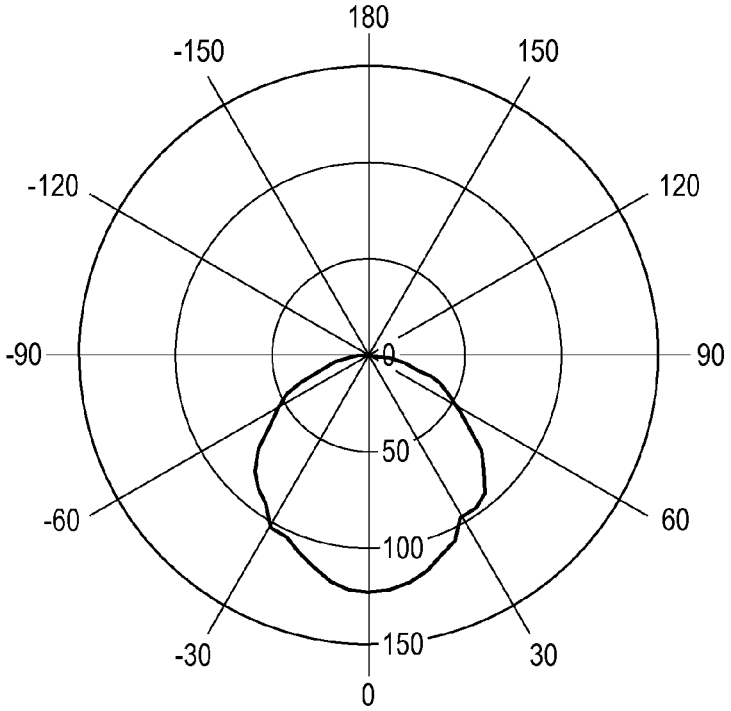
FIG. 8 depicts a plot of a luminous distribution produced by the lighting device of FIG. 7 in the direction of the tubular body.

FIG. 7 depicts a cross-sectional light distribution plot of the lighting device 100 of FIGS. 4-6 and FIG. 8 depicts a light distribution plot of the lighting device 100 of FIGS. 4-6 along the tubular body 20. As is particularly apparent from the light distribution plot in FIG. 7, the lighting device 100 is capable of producing a luminous distribution over a range of angles approximating 260° with excellent light intensity, thereby demonstrating the improved luminous efficiency of the lighting device 100 compared to prior art lighting devices such as the lighting device 10.

It will be appreciated that the angular luminous distribution may be adjusted by altering the angular range over which the first arcuate section 121 of the tubular body 120 spans, as explained in more detail above. In an embodiment, the angular range over which the first arcuate section 121 spans is maximized, i.e. the dimensions of the second inner volume 104 are minimized such that the one or more driver circuits 150 snugly fit into the second inner volume 104, i.e. the unoccupied part of the second inner volume 104 is minimized. This may be achieved by providing a carrier 130 (and if present a reflective layer 140) of which the portions 131 (and the second portions 146 of the reflective layer 140 if present) are angled accordingly, as explained in more detail above.

At this point, it is noted that the tubular body 120 may be made of any suitable transparent material, such as glass or a suitable polymer such as PC, PMMA and PET. The translucent region 122 may be formed in any suitable manner, for instance by etching a portion of the glass or polymer to form the translucent region 122. Alternatively, in case of a polymer tubular body 120, the translucent region 122 may be formed by blending diffusive particles or a pigment into a part of the tubular body 120 to define the translucent region 122, or by co-extrusion using a transparent polymer to form the second arcuate section 124 and the transparent region(s) 123 and a translucent polymer to form the translucent region 122.

Figure 9:
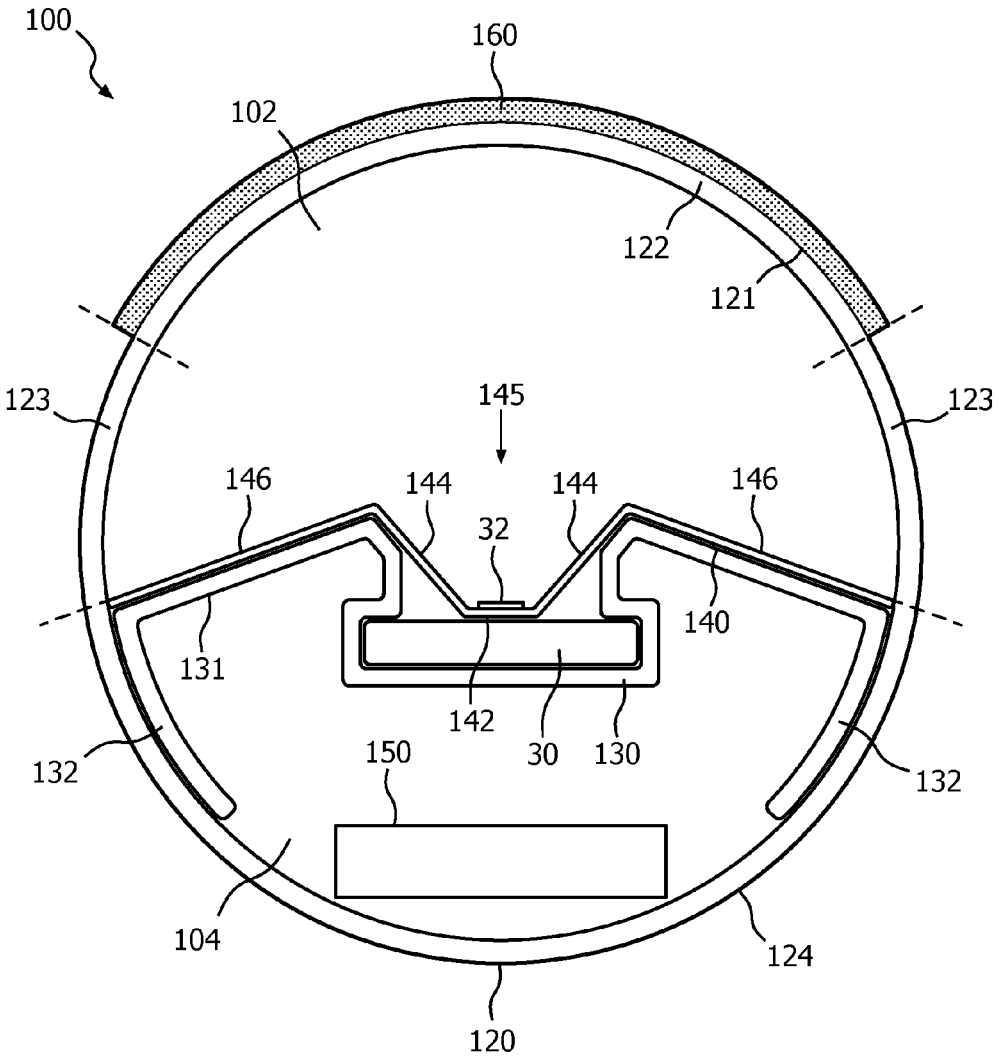
FIG. 9 schematically depicts a cross-section of a lighting device according to another embodiment of the present invention.
Figure 10:
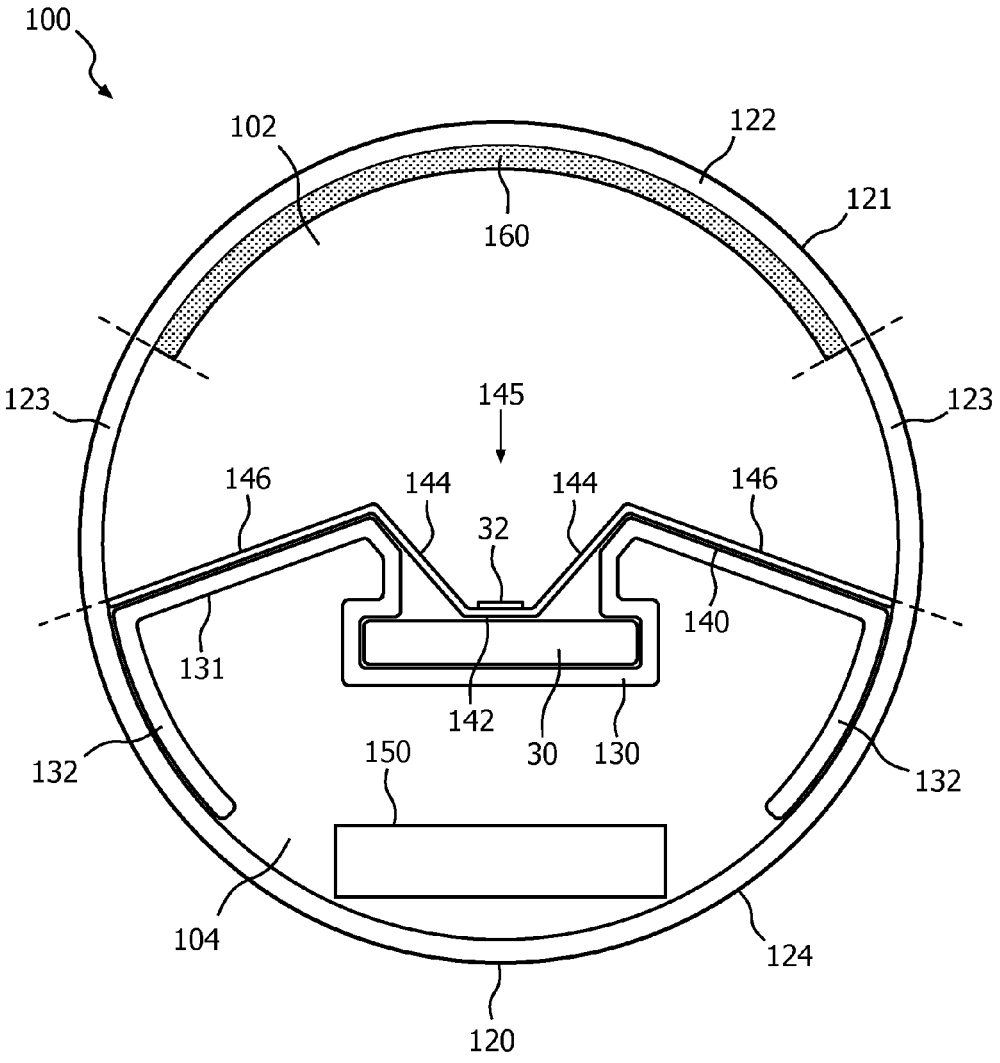
FIG. 10 schematically depicts a cross-section of a lighting device according to yet another embodiment of the present invention.

FIG. 9 schematically depicts another embodiment of a lighting device 100. The lighting device 100 shown in FIG. 9 is the same as the lighting device 100 as shown in FIG. 4-6 with the exception that the translucent region 122 is formed by a translucent film 160 applied to an external surface portion of the tubular body 120. Any suitable material may be used to form the translucent film 160. The translucent film 160 may be adhered to the external surface portion of the tubular body 120 in any suitable manner, for instance using an adhesive, through electrostatic bonding and so on. The translucent film 160 does not necessarily have to be applied to an external surface portion of the tubular body 120; FIG. 10 schematically depicts an embodiment of the lighting device 100 in which the translucent film 160 is applied to an internal surface portion of the tubular body 120 to form the translucent region 122.

In an embodiment, the lighting device 100 is a tubular light bulb such as a tubular LED bulb. Although not shown in any of the drawings, the lighting device 100 may comprise a cap at a terminal portion of the tubular body 120 or a pair of caps at opposite ends of the tubular body 120 for connecting the lighting device 100 to a power supply as is well-known in the art.

Figure 11:
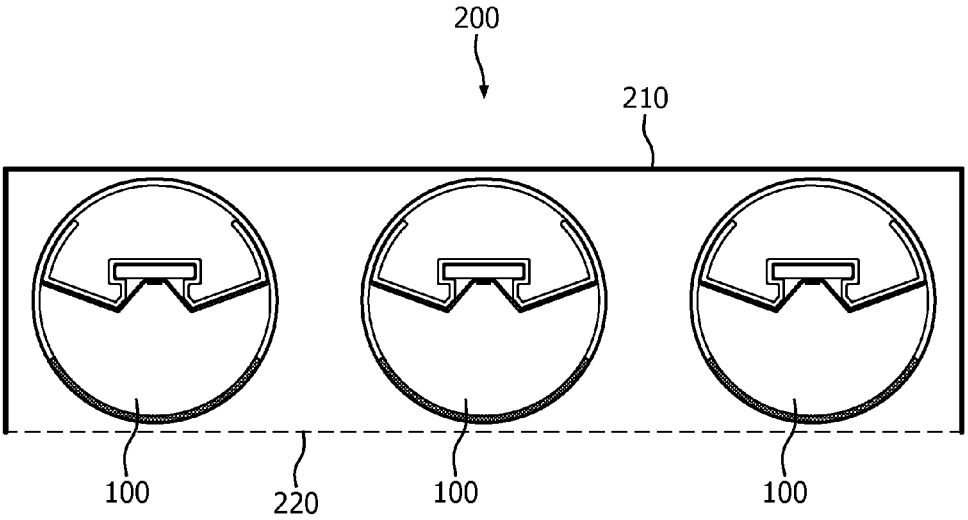
FIG. 11 schematically depicts a cross-section of a luminaire according to an example embodiment of the present invention.

The lighting device 100 according to embodiments of the present invention may be advantageously included in a luminaire such as a holder of the lighting device, e.g. a ceiling light fitting, an armature for fitting underneath a cabinet or the like, an apparatus into which the lighting device is integrated, e.g. a cooker hood or the like, and so on. FIG. 11 schematically depicts a luminaire 200 comprising a plurality of lighting devices 100 fitted in a housing 210 of the luminaire 200. The luminaire 200 further comprises a light exit window 220, which light exit window 220 optionally may comprise beam shaping means such as one or more lens arrays, reflectors and so on. Alternatively, the light exit window 220 may simply be formed by an opening in the housing 210. The internal surfaces of the housing 210 may be reflective to reflect light that exits the lighting devices 100 in a direction other than towards the light exit window 220, such as the light that exits the lighting devices 100 through the respective transparent regions 123 shown in more detail in FIGS. 4, 5, 9 and 10.

In particular, because the lighting devices 100 are capable of generating a substantial amount of light beyond a 90° angle (as defined relative to the optical axis of the luminous distribution produced by the SSL elements 32) as shown in FIG. 7, the lighting devices 100 are capable of generating light backwards, i.e. towards the surface of the housing 210 opposite the light exit window 220 despite the fact that the respective luminous surfaces of the SSL elements 32 are facing the light exit window 220. Consequently, the luminaire 200 including the lighting devices 100 is capable of producing an appearance that is very similar to the appearance produced by a luminaire comprising traditional fluorescent or phosphorescent light tubes without suffering a loss in luminous efficiency caused by light generated towards the surface of the housing 210 opposite the light exit window 220 in a direction perpendicular to this surface, as is the case with such fluorescent or phosphorescent light tubes, as the light is generated on the such perpendicular angles is reflected back into the light tubes.

Furthermore, the increase in luminous distribution angles produced by the lighting devices 100 produces a better uniformity in the luminous output of a plurality of luminaires 200 that are used to illuminate an area of a dwelling such as an office space, room, hall, exercise area and so on, even if these luminaires 200 are spaced relatively far apart. In a non-limiting example, such luminaires 200 may be ceiling armatures, e.g. armatures that are integrated in a suspended ceiling. Other examples of such luminaires 200 will be immediately apparent to the skilled person.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A lighting device comprising a tubular body, said tubular body comprising a carrier mounted inside the tubular body such that the tubular body comprises:

a first inner volume delimited by a first arcuate section of the tubular body and the carrier; and a second inner volume delimited by a second arcuate section of the tubular body and the carrier, wherein:

the carrier supports a plurality of solid state lighting elements arranged to emit a luminous output into the first inner volume; and the first arcuate section comprises a transparent region and a translucent region obscuring the solid state lighting elements, said transparent region extending from the translucent region to the carrier; wherein the carrier comprises a central region extending along the length of the tubular body, and defining a recess in which the solid state lighting elements are located, which recess prevents the entirety of the solid state lighting elements from being directly observable through the transparent region of the first arcuate section, wherein light generated by the solid state lighting elements is diffused by the translucent region, and wherein the light is partially reflected by the translucent region and directed toward the transparent region.

2. The lighting device of claim 1, wherein the first arcuate section comprises a pair of transparent regions each extending from the translucent region to the carrier said transparent regions facing each other, wherein the translucent region extends between said transparent regions.

3. The lighting device of claim 1, wherein the translucent region comprises a translucent film on a surface portion of the tubular body.

4. The lighting device of claim 1, wherein the carrier comprises a heat sink.

5. The lighting device of claim 1, wherein the solid state lighting elements are mounted on a printed circuit board supported by said carrier.

6. The lighting claim 1, wherein the carrier comprises a reflective surface facing the first inner volume.

7. The lighting device of claim 6, wherein the reflective surface comprises:

a central portion comprising a plurality of apertures each exposing one of said solid state lighting elements;

a pair of sloped first sections extending from said central portion and defining a trench in which the solid state lighting elements are located; and a pair of second sections each extending from one of the first sections to the tubular body.

8. The lighting device of claim 7, wherein each second section is angled from a first section to the tubular body such that the first arcuate section extends over angular range of more than 180°.

9. The lighting device of claim 6, wherein the reflective surface is a reflective layer on the heat sink.

10. The lighting device of claim 1, wherein the carrier further comprises a pair of arcuate carrier sections, each arcuate carrier section extending along a portion of the second arcuate section of the tubular body.

11. The lighting device of claim 1, wherein the tubular body is a glass body or a plastic body.

12. The lighting device of claim 11, wherein the plastic is selected from polycarbonate, poly ethylene terephthalate and poly or mixtures thereof.

13. The lighting device of claim 1, wherein the translucent region is an arcuate section that forms between 25-40% of a circumference of the tubular body.

14. The lighting device of claim 13, wherein the first arcuate section covers an angular range of at least 180° of the circumference of the tubular body.

15. The lighting device of claim 1, further comprising driver circuitry for driving the plurality of solid state lighting elements, said driver circuitry being located in the second inner volume.

16. A luminaire comprising the lighting device of claim 1.

17. The lighting device of claim 1, wherein the transparent region is an arcuate section that forms at least thirty-six degrees of the tubular body measured circumferentially.

18. The lighting device of claim 17, wherein the arcuate section comprises a pair of arcuate sections circumferentially positioned on opposite sides of the translucent region.

* * * * *